US006778794B2

(12) United States Patent
Kayahara

(10) Patent No.: US 6,778,794 B2
(45) Date of Patent: Aug. 17, 2004

(54) IMAGE FORMING APPARATUS HAVING DISCHARGING DEVICE FOR DISCHARGING INTERMEDIATE TRANSFER DEVICE

(75) Inventor: Shin Kayahara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/155,133

(22) Filed: May 28, 2002

(65) Prior Publication Data

US 2003/0007806 A1 Jan. 9, 2003

(30) Foreign Application Priority Data

May 28, 2001 (JP) ..... 2001-159403

(51) Int. Cl.[7] ..... G03G 21/00
(52) U.S. Cl. ..... 399/129; 399/71
(58) Field of Search ..... 399/129, 71, 127, 399/302, 308

(56) References Cited

U.S. PATENT DOCUMENTS

| | | | |
|---|---|---|---|
| 5,600,405 | A | 2/1997 | Umeda et al. |
| 5,983,060 | A | 11/1999 | Namekata et al. |
| 6,061,543 | A | 5/2000 | Kayahara et al. |
| 6,212,351 | B1 | 4/2001 | Kawagoe et al. |
| 6,269,228 | B1 | 7/2001 | Kayahara et al. |

FOREIGN PATENT DOCUMENTS

| | | |
|---|---|---|
| JP | 2870145 | 3/1992 |
| JP | 06-161298 | 6/1994 |
| JP | 11-202642 | 7/1999 |
| JP | 2000-56588 | 2/2000 |
| JP | 2000-162894 | 6/2000 |
| JP | 2000-227727 | 8/2000 |
| JP | 2000-231286 | 8/2000 |
| JP | 2001-125449 | 5/2001 |

*Primary Examiner*—Quana Grainger
(74) *Attorney, Agent, or Firm*—Oblon, Spivak, McClelland, Maier & Neustadt, P.C.

(57) ABSTRACT

An image forming apparatus including at least one image carrier for carrying a visual image formed thereon, an intermediate transfer element for carrying the visual image from the at least one image carrier to a recording material, a primary transfer device for transferring the visual image from the at least one image carrier onto the intermediate transfer element, a secondary transfer device for transferring the visual image on the intermediate transfer element onto the recording material, a cleaning device for mechanically removing developer remaining on the intermediate transfer element, and a discharging device for discharging the intermediate transfer element. The discharging device is positioned in downstream of the secondary transfer device and upstream of the cleaning device in a moving direction of the intermediate transfer element.

17 Claims, 4 Drawing Sheets

FIG. 2A
BACKGROUND ART
AFTER SECONDARY TRANSFER
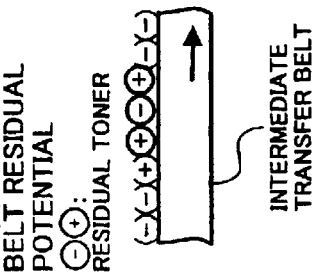
FIG. 2B
BACKGROUND ART
CLEANING
FIG. 2C
BACKGROUND ART
AT THE MOMENT OF SEPARATION OF CLEANING BLADE
FIG. 2D
BACKGROUND ART
DURING SEPARATION OF CLEANING BLADE
FIG. 2E
BACKGROUND ART
DISCHARGING →SUBSEQUENT IMAGE FORMING
FIG. 2F
AFTER SECONDARY TRANSFER
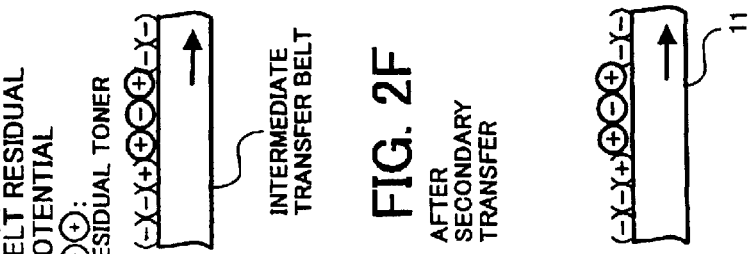
FIG. 2G
DISCHARGING
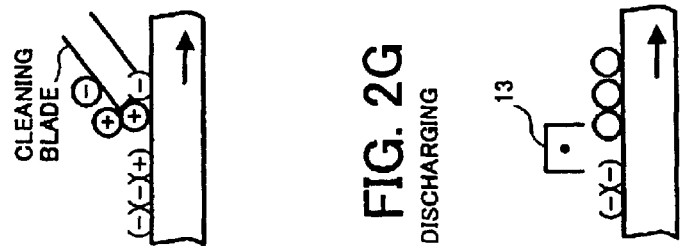
FIG. 2H
CLEANING
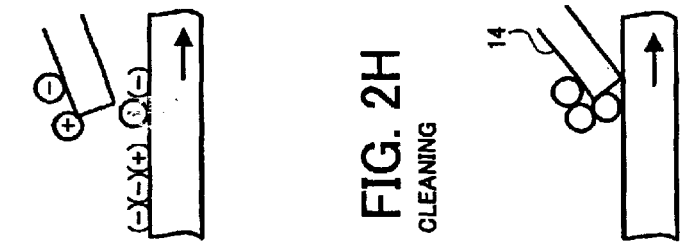
FIG. 2I
AT THE MOMENT OF SEPARATION OF CLEANING BLADE
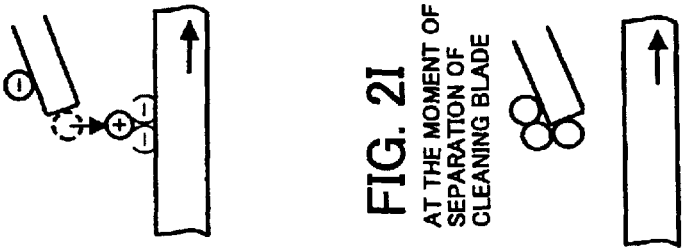
FIG. 2J
DURING SEPARATION OF CLEANING BLADE →SUBSEQUENT IMAGE FORMING
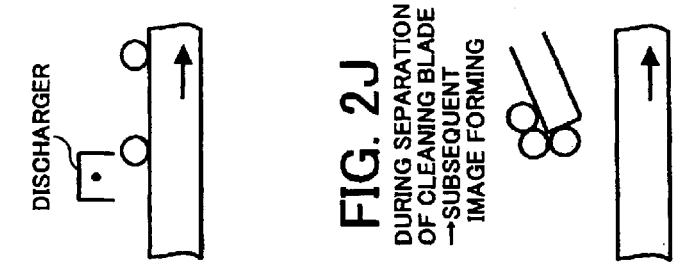

IMAGE FORMING APPARATUS HAVING DISCHARGING DEVICE FOR DISCHARGING INTERMEDIATE TRANSFER DEVICE

CROSS-REFERENCE TO RELATED APPLICATIONS

The present application claims priority to Japanese Patent Application No. 2001-159403, filed May 28, 2001. The contents of that application are incorporated herein by reference in their entirety.

BACKGROUND OF THE INVENTION

1. Field of the Invention

The present invention relates to an image forming apparatus such as a copying machine, a printer, a facsimile machine, or other similar image forming apparatus.

2. Discussion of the Background

An image forming apparatus such as a copying machine, a printer, a facsimile machine, or other similar image forming apparatus, employs a transfer method in which a visual image, e.g. a toner image, formed on an image carrier such as a photoreceptor is transferred onto a recording material, e.g., a transfer sheet, via an intermediate transfer element. An image forming apparatus using an intermediate transfer element is widely used because of advantages in forming visual images on sheets of various sizes and in numerous layouts of devices in the image forming apparatus.

There are two types of the above-described image forming apparatuses using the intermediate transfer element: (1) an image forming apparatus including a single image carrier and an intermediate transfer element; and (2) an image forming apparatus including a plurality of image carriers and an intermediate transfer element (so-called tandem type image forming apparatus). The tandem type image forming apparatus is mainly used for obtaining a large number of copies or prints.

As an intermediate transfer element in the above-described image forming apparatus, an endless belt including a single layer or plural layers is often used. An intermediate transfer element typically has a volume resistivity from $10^7$ ωcm to $10^{15}$ ωcm. A discharging device may be provided to remove a residual charge on the intermediate transfer element if the intermediate transfer element is electrically charged. Further, a cleaning device in a shape of blade or brush is commonly used for removing unnecessary toner remaining on the intermediate transfer element.

Generally, a discharging device for an intermediate transfer element is provided in downstream of a cleaning device in a rotating direction of the intermediate transfer element. For example, Japanese Patent Laid-open Publications No. 6-161298 and No. 2000-56588 describe image forming apparatuses including such discharging devices.

Japanese Patent Laid-open Publication No. 6-161298 describes an image forming apparatus in which a charge on a filming layer in an intermediate transfer element is removed to obtain adequate and stable transfer efficiency for a long period of time. Japanese Patent Laid-open Publication No. 2000-56588 describes an image forming apparatus in which image unevenness is prevented from occurring in an image forming process by uniformly removing a residual charge remaining on an intermediate transfer element.

An image forming apparatus typically has a problem of removed toner attaching back onto an intermediate transfer element. Specifically, residual toner, which has been removed from the intermediate transfer element by a cleaning device, moves back onto the intermediate transfer element from the cleaning device because a charging condition of the residual toner removed by the cleaning device is not controlled. The toner re-attached to the intermediate transfer element remains in a subsequent image forming process and stains a toner image formed on the intermediate transfer element in the subsequent image forming process, resulting in an image deterioration.

SUMMARY OF THE INVENTION

According to one aspect of the present invention, an image forming apparatus includes at least one image carrier configured to carry a visual image formed thereon, an intermediate transfer element configured to carry the visual image from the at least one image carrier to a recording material, a primary transfer device configured to transfer the visual image from the at least one image carrier onto the intermediate transfer element, and a secondary transfer device configured to transfer the visual image on the intermediate transfer element onto the recording material, a cleaning device configured to make contact with the intermediate transfer element to mechanically remove developer remaining on the intermediate transfer element, and a discharging device configured to discharge the intermediate transfer element. The discharging device is positioned in downstream of the secondary transfer device and upstream of the cleaning device in a moving direction of the intermediate transfer element.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 2A through 2J are schematic illustrations for explaining a process of discharging and cleaning an intermediate transfer belt according to the embodiment of the present invention by comparison with a cleaning and discharging process according to a background art;

DESCRIPTION OF THE PREFERRED EMBODIMENTS

Figure 1:
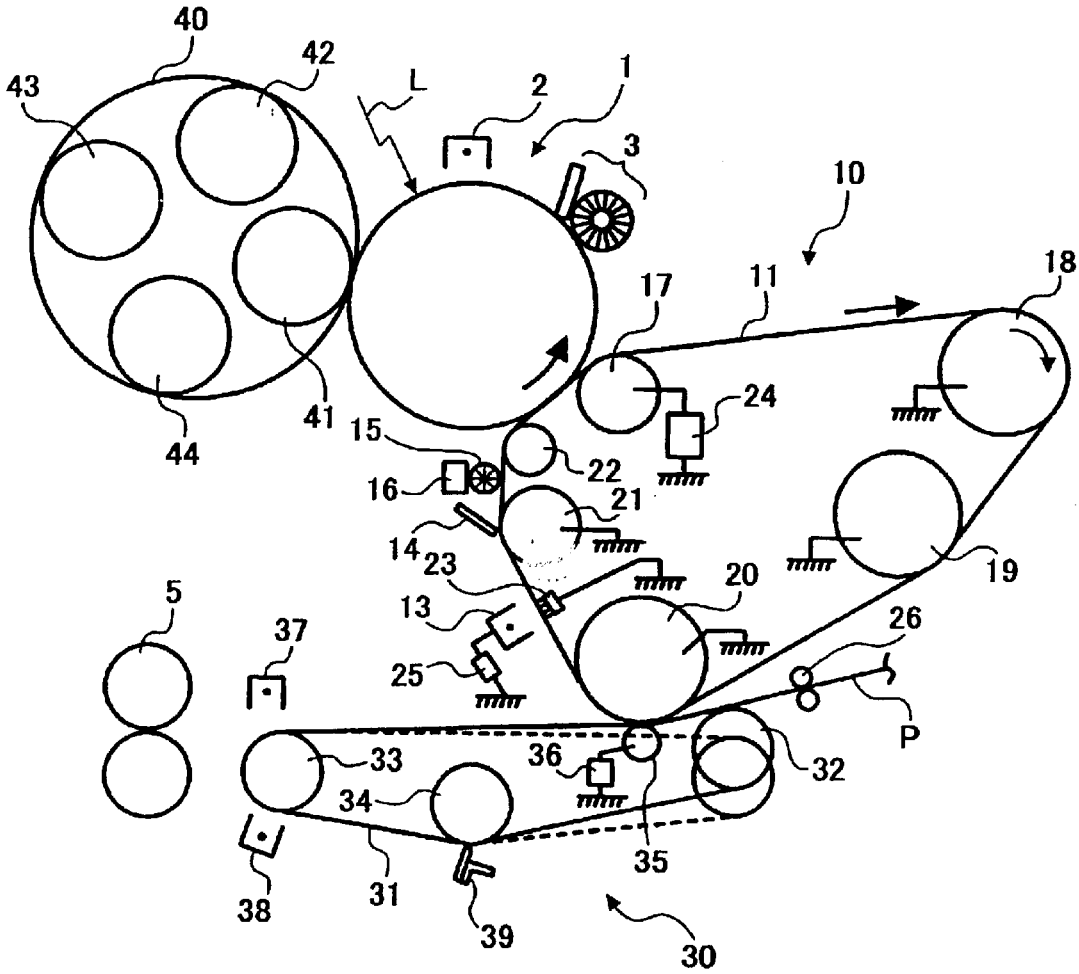
FIG. 1 is a schematic view illustrating a construction of an image forming section of a color copying machine according to an embodiment of the present invention.

Preferred embodiments of the present invention are described in detail referring to the drawings, wherein like reference numerals designate identical or corresponding parts throughout the several views. Hereinafter described are two types of image forming apparatuses to which the present invention is applied. One type of image forming apparatus includes a single photoreceptor, and another type of image forming apparatus includes a plurality of photoreceptors, i.e., a tandem type image forming apparatus.

FIG. 1 is a schematic view illustrating a construction of an image forming section as a main section of a color copying machine including a single photoreceptor according to an embodiment of the present invention. The color copying machine includes the image forming section illustrated in FIG. 1, a color image reading section (not shown, hereinafter referred to as a "color scanner section"), a sheet feeding section (not shown), and a control section (not shown) that controls the above-described sections to operate.

As illustrated in FIG. 1, the image forming section includes a drum-shaped photoreceptor 1 (hereinafter referred to as a "photosensitive drum 1") serving as an image carrier, a charger 2 serving as a charging device, a photosensitive drum cleaning unit 3 including a cleaning blade and a fur brush, an optical writing unit (not shown) serving as an exposure device, a revolver type developing device 40, an intermediate transfer unit 10, a secondary transfer unit 30, and a fixing unit including a pair of fixing rollers 5.

The photosensitive drum 1 is rotated in a counterclockwise direction indicated by the arrow on the photosensitive drum 1. Arranged around the photosensitive drum 1 are the charger 2, the photosensitive drum cleaning unit 3, a selected developing unit of the revolver type developing device 40, and an intermediate transfer belt 11 as an intermediate transfer element in the intermediate transfer unit 10, etc.

The optical writing unit (not shown) converts color image data output from the color scanner section to optical signals, and irradiates a surface of the photosensitive drum 1 uniformly charged by the charger 2 with a laser light (L) corresponding to an image of an original document, thereby forming electrostatic latent images on the surface of the photosensitive drum 1.

The revolver type developing device 40 includes a Bk developing unit 41 containing a black (hereinafter abbreviated as "Bk") toner, a C developing unit 42 containing a cyan ("C") toner, a M developing unit 43 containing a magenta ("M") toner, a Y developing unit 44 containing a yellow ("Y") toner, and a drive unit (not shown) that drives the revolver type developing device 40 to rotate in the clockwise direction in FIG. 1.

In this embodiment, a developer including a mixture of a color toner and a ferrite carrier is contained in each of the developing units 41–44. The color toner contained in each of the developing units 41–44 is negatively charged while being agitated with the ferrite carrier. A developing bias voltage, in which an alternating voltage "Vac" is superimposed on a negative direct current voltage "Vdc", is applied to developing sleeves (not shown) in the developing units 41–44 from a developing bias power supply (not shown) as a developing bias voltage applying device. Each of the developing sleeves in the developing units 41–44 is biased with a predetermined voltage relative to a metallic base layer of the photosensitive drum 1.

When a copy start key on an operation panel (not shown) is pressed, the color scanner section starts reading color image data of an original document. The optical writing unit irradiates the surface of the photosensitive drum 1 with the laser light (L) based on the color image data of the original document read by the color scanner section, thereby forming electrostatic latent images of respective colors. Hereinafter, an electrostatic latent image based on Bk image data will be referred to as a "Bk electrostatic latent image". Similarly, electrostatic latent images based on C, M, and Y image data will be referred to as a "C electrostatic latent image", a "M electrostatic latent image", and a "Y electrostatic latent image", respectively.

In order to ensure that a leading edge portion of the Bk electrostatic latent image is developed with Bk toner, a Bk developing sleeve starts to rotate before the leading edge portion of the Bk electrostatic latent image arrives at a developing position. At the developing position, the Bk developing unit 41 develops the Bk electrostatic latent image with Bk toner. When the trailing edge portion of the Bk electrostatic latent image passes the developing position, the revolver type developing device 40 is rotated until the developing unit of subsequent color moves to the developing position. The developing unit of subsequent color should be completed to arrive at the developing position at least before a leading edge portion of an electrostatic latent image based on subsequent color image data arrives at the developing position.

The intermediate transfer unit 10 includes the intermediate transfer belt 11 as an intermediate transfer element spanned around a plurality of rollers (details of which will be described later). Arranged around the intermediate transfer belt 11 are a secondary transfer belt 31 as a recording material carrier of the secondary transfer unit 30, a secondary transfer bias roller 35 as a secondary transfer device, a belt cleaning blade 14 as an intermediate transfer element cleaning device, a lubricant applying brush 15 as a lubricant applying device, etc, all of which face the intermediate transfer belt 11.

Further, a discharger 13 is provided in downstream of the secondary transfer device, i.e., the secondary transfer bias roller 35, and upstream of the belt cleaning blade 14 in the rotating direction of the intermediate transfer belt 11. The discharger 13 serves as a discharging/charging device that discharges and charges the intermediate transfer element, i.e., the intermediate transfer belt 11.

The intermediate transfer belt 11 is spanned around a primary transfer bias roller 17 as a primary transfer device, a belt drive roller 18, a belt tension roller 19, a secondary transfer facing roller 20 facing the secondary transfer bias roller 35, a cleaning facing roller 21 facing the belt cleaning blade 14, and a ground roller 22. Each of the rollers is formed from conductive material, and the rollers other than the primary transfer bias roller 17 are grounded. Further, a ground brush 23 is provided in contact with the intermediate transfer belt 11 as an opposite electrode of the discharger 13, and is grounded.

A transfer bias controlled to be a predetermined value of current or voltage is applied to the primary transfer bias roller 17 from a primary transfer power supply 24 subjected to constant current or constant voltage control. The intermediate transfer belt 11 is driven to be rotated in a clockwise direction indicated by the arrow along the intermediate transfer belt 11 by the belt drive roller 18 driven to rotate in the clockwise direction in FIG. 1 by a drive motor (not shown).

An electric field necessary for discharging and charging the intermediate transfer belt 11 is applied to the discharger 13 from a discharge power supply 25 which supplies a bias in which a direct current component is superimposed on an alternating current component. The intermediate transfer belt 11 is formed from a semiconductor or an insulator, and has a single or multiple layer structure.

At a transfer region where a toner image on the photosensitive drum 1 is transferred onto the intermediate transfer belt 11 (hereinafter referred to as a "primary transfer region"), the intermediate transfer belt 11 is stretched so that the intermediate transfer belt 11 is pressed against the photosensitive drum 1 by the primary transfer bias roller 17 and the ground roller 22. Thereby, a nip part having a predetermined width is formed between the photosensitive drum 1 and the intermediate transfer belt 11.

The lubricant applying brush 15 grinds zinc stearate 16 of plate-like shape into lubricant so as to apply fine ground particles onto the intermediate transfer belt 11. The lubricant applying brush 15 is brought into contact with and separated from the intermediate transfer belt 11. The lubricant applying brush 15 is controlled to contact the intermediate transfer belt 11 at a predetermined timing.

The secondary transfer unit 30 includes the secondary transfer belt 31 spanned around three support rollers 32, 33, 34. A part of the secondary transfer belt 31 stretched between the support rollers 32, 33 is allowed to be press-contacted against the secondary transfer facing roller 20 of the intermediate transfer unit 10. One of the three support rollers 32, 33, 34 serves as a drive roller driven to rotete by a drive device (not shown). The secondary transfer belt 31 is driven to rotate in a counterclockwise direction in FIG. 1 by the drive roller.

The secondary transfer bias roller 35 serves as a secondary transfer device and is arranged such that the intermediate transfer belt 11 and the secondary transfer belt 31 are sandwiched between the secondary transfer facing roller 20 and the secondary transfer bias roller 35. A transfer bias of a predetermined current is applied to the secondary transfer bias roller 35 from a secondary transfer power supply 36 subjected to constant current control. Further, the support roller 32 and the secondary transfer bias roller 35 are moved up and down by a mechanism (not shown) so as to allow the secondary transfer belt 31 and the secondary transfer bias roller 35 to be brought into contact with and separated from the secondary transfer facing roller 20. The secondary transfer belt 31 and the support roller 32 separated from the secondary transfer facing roller 20 are illustrated by the broken lines in FIG. 1.

A pair of registration rollers 26 are provided at the right side of the support roller 32 in FIG. 1, and feed a transfer sheet (P) as a recording material toward between the intermediate transfer belt 11 and the secondary transfer belt 31 as these belts are sandwiched between the secondary transfer bias roller 35 and the secondary transfer facing roller 20 at an appropriate timing.

A transfer sheet discharger 37 as a recording material discharging device and a belt discharger 38 as a recording material carrier discharging device face a part of the secondary transfer belt 31 stretched at the support roller 33 provided at the side of the pair of fixing rollers 5. Further, a cleaning blade 39 as a recording material carrier cleaning device abuts a part of the secondary transfer belt 31 stretched at the support roller 34 provided at a lower side of the secondary transfer belt 31 in FIG. 1.

The transfer sheet discharger 37 removes a charge from a transfer sheet to allow the transfer sheet to be adequately separated from the secondary transfer belt 31 by a tension of the transfer sheet. The belt discharger 38 removes a charge remaining on the secondary transfer belt 31. The cleaning blade 39 removes remainings adhered onto the surface of the secondary transfer belt 31.

In the above-described color copying machine, upon starting an image forming cycle, the photosensitive drum 1 is rotated in the counterclockwise direction indicated by the arrow on the photosensitive drum 1 by a drive motor (not shown), and the intermediate transfer belt 11 is rotated in the clockwise direction indicated by the arrow along the intermediate transfer belt 11 in FIG. 1 by the belt drive roller 18. A Bk toner image formation, a C toner image formation, a M toner image formation, and a Y toner image formation are sequentially performed with the rotations of the intermediate transfer belt 11. The formed toner images of respective colors are primarily transferred onto the intermediate transfer belt 11 by the transfer bias voltage applied to the primary transfer bias roller 17 in each time. Consequently, the color toner images are superimposed on the intermediate transfer belt 11 in the order of black, cyan, magenta and yellow.

The residual toner remaining on the photosensitive drum 1 after the primary transferring onto the intermediate transfer belt 11 is cleaned by the photosensitive drum cleaning unit 3 for the preparation of the photosensitive drum 1 in a next use.

Thus, the Bk, C, M, Y toner images sequentially formed on the photosensitive drum 1 are sequentially transferred onto the intermediate transfer belt 11 so that the Bk, C, M, Y toner images are superimposed on the same surface of the intermediate transfer belt 11 with each other in alignment. Thereby, a superimposed color (four color at the maximum) toner image is formed on the intermediate transfer belt 11.

When the above-described image forming operation starts, a transfer sheet (P) is fed from a sheet feeding section (not shown) such as a transfer sheet cassette and a manual sheet feeding tray, and is in a standby condition at a nip part formed between the pair of registration rollers 26. When a leading edge of a toner image on the intermediate transfer belt 11 is about to enter a secondary transfer region where a nip is formed between the secondary transfer facing roller 20 and the secondary transfer bias roller 35, the registration rollers 26 are driven so that the leading edge of the transfer sheet (P) coincides with the leading edge of the toner image. Thereby, the registration of the transfer sheet (P) and the toner image is performed.

Subsequently, the transfer sheet (P) superimposed with the toner image on the intermediate transfer belt 11 passes through the secondary transfer region. At this time, the four color toner image on the intermediate transfer belt 11 is transferred onto the transfer sheet (P) altogether by the transfer bias voltage applied to the secondary transfer bias roller 35 from the secondary transfer power supply 36. Hereinafter, a transfer of a toner image from the intermediate transfer belt 11 to a transfer sheet (P) will be referred to as a "secondary transfer".

At substantially the same timing as the start of the secondary transfer, the discharge power supply 25 starts to output voltage to the discharger 13. Thereby, the discharger 13 discharges the intermediate transfer belt 11 and residual toner remaining on the intermediate transfer belt 11 after a toner image is transferred onto a transfer sheet (P). At this time, the voltage output from the discharge power supply 25 is controlled such that only alternating current component is present. Therefore, the intermediate transfer belt 11 and the residual toner on the intermediate transfer belt 11 are control-led to be charged to a nearly zero level.

The residual toner on the intermediate transfer belt 11, once discharged by the discharger 13, is removed from the intermediate transfer belt 11 by the belt cleaning blade 14 which is pressed against the intermediate transfer belt 11. The belt cleaning blade 14 is brought into contact with and separated from the intermediate transfer belt 11 by a mechanism (not shown). In this condition, because the residual toner on the intermediate transfer belt 11 is sufficiently discharged by the discharger 13, the force which allows the residual toner to electrostatically adhere to the surface of the intermediate transfer belt 11 is decreased, so that the residual toner is more effectively removed by the belt cleaning blade 14. In addition, because the intermediate transfer belt 11 is also sufficiently discharged by the discharger 13, the force which makes the intermediate transfer belt 11 to electrostatically attract the residual toner held on the belt cleaning blade 14 is decreased, so that the re-attachment of the residual toner to the intermediate transfer belt 11 described above does not occur.

Referring to FIGS. 2A through 2J, a process of discharging and cleaning the intermediate transfer belt 11 will be described in comparison with a cleaning and discharging process according to a background art. FIGS. 2A through 2E schematically illustrate a cleaning and discharging process according to a background art. FIGS. 2F through 2J schematically illustrate a discharging and cleaning process according to this embodiment of the present invention.

FIGS. 2A and 2F illustrate an intermediate transfer belt after a secondary transfer. After the secondary transfer, a negatively charged portion is substantially dominant on the intermediate transfer belt with the exception of a positively charged partial portion. Further, a mixture of positively and negatively charged toners remain on the intermediate transfer belt. Generally, the positively charged toner which has received the charge at the secondary transfer region is dominant on the intermediate transfer belt.

In the case of the background art, after the secondary transfer (FIG. 2A), a cleaning process is performed in FIG. 2B. Referring to FIG. 2B, a cleaning blade mechanically scrapes residual toner off the intermediate transfer belt. However, at the moment when the cleaning blade is separated from the intermediate transfer belt, a part of the residual toner remains on the intermediate transfer belt as illustrated in FIG. 2C. This is caused because an electrostatic attractive force on the charged intermediate transfer belt for retaining the charged residual toner is greater than the force which allows the residual toner to adhere to the cleaning blade.

Further, as illustrated in FIG. 2D, when the negatively charged portion of the intermediate transfer belt passes by the cleaning blade separated from the intermediate transfer belt by a small gap, the toner held on the cleaning blade, which is still adhered to the cleaning blade at the moment when the cleaning blade is separated from the intermediate transfer belt, may move back to the intermediate transfer belt due to the electrostatic attractive force of the charged intermediate transfer belt. Subsequently, a discharging process is performed in FIG. 2E, and a subsequent image forming process follows. However, the residual toner remains on the intermediate transfer belt.

On the other hand, in the present embodiment, after the secondary transfer (FIG. 2F), the discharger 13 discharges the intermediate transfer belt 11 and the residual toner remaining on the intermediate transfer belt 11 in FIG. 2G. Subsequently, a cleaning process is performed in FIG. 2H. In the cleaning process, because the intermediate transfer belt 11 and the residual toner remaining on the intermediate transfer belt 11 are discharged and the force which allows the residual toner to adhere to the intermediate transfer belt 11 is small, the belt cleaning blade 14 can easily scrape the residual toner off the intermediate transfer belt 11. When the belt cleaning blade 14 is separated from the intermediate transfer belt 11, the re-attachment of the toner held on the belt cleaning blade 14 to the intermediate transfer belt 11 due to the electrostatic attractive force does not occur in FIGS. 2I and 2J. As a result, referring to FIG. 2J. the intermediate transfer belt 11 is moved for a subsequent image forming process without having residual toner thereon.

In the above-described embodiment, the charging condition of the residual toner and the intermediate transfer belt 11 after the secondary transfer can be controlled before the residual toner remaining on the intermediate transfer belt 11 is scraped off by the belt cleaning blade 14. Therefore, the residual toner once scraped off by the belt cleaning blade 14 is prevented from re-attaching to the intermediate transfer belt 11, and thereby a high quality image can be obtained without deterioration of image due to the re-attachment of the residual toner to the intermediate transfer belt 11.

Referring back to FIG. 1, an operation after the secondary transfer according to the present embodiment will be described.

The transfer sheet (P) is discharged when the transfer sheet (P) passes a facing part where the transfer sheet (P) faces the transfer sheet discharger 37 arranged in downstream of the secondary transfer region in the moving direction of the secondary transfer belt 31. Thereafter, the transfer sheet (P) is separated from the secondary transfer belt 31 and conveyed to the pair of the fixing rollers 5. The toner image on the transfer sheet (P) is fused and fixed at a nip part of the pair of the fixing rollers 5. The transfer sheet (P) having a fixed toner image is discharged from the main body of the color copying machine by a pair of sheet discharging rollers (not shown) and is stacked on a sheet discharging tray (not shown) with the image on the transfer sheet (P) being face up. As a result, a full color copy is obtained.

The surface of the photosensitive drum 1 after the primary transfer, i.e., a transfer of a toner image from the photosensitive drum 1 to the intermediate transfer belt 11 is cleaned by the photosensitive drum cleaning unit 3 and is uniformly discharged by a discharging lamp (not shown).

Figure 3A:
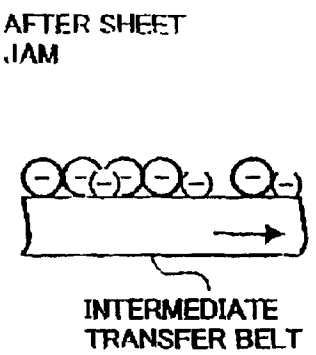
FIG. 3A BACKGROUND ART
FIGS. 3A through 3G are schematic illustrations for explaining a clearing mode for a belt cleaning blade according to the embodiment of the present invention by comparison with a background art.
Figure 3B:
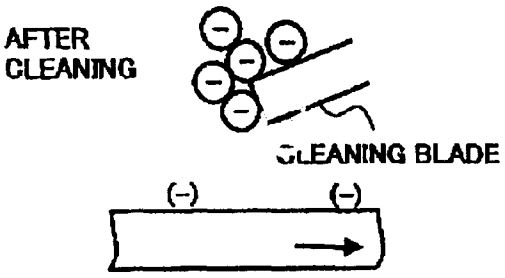
FIG. 3B BACKGROUND ART
Figure 3C:
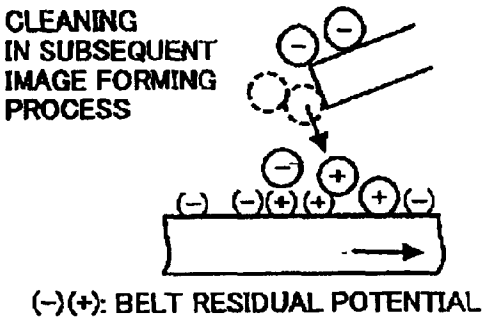
FIG. 3C BACKGROUND ART

Next, respective clearing modes for the belt cleaning blade 14 and the lubricant applying brush 15 in the intermediate transfer unit 10 are described in comparison with a background art referring to FIGS. 3A through 3G. FIGS. 3A through 3C schematically illustrate a cleaning process according to the background art. FIGS. 3D through 3G schematically illustrate a cleaning process and a clearing mode according to this embodiment of the present invention.

Figure 3D:
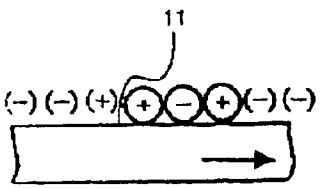
Figure 3E:
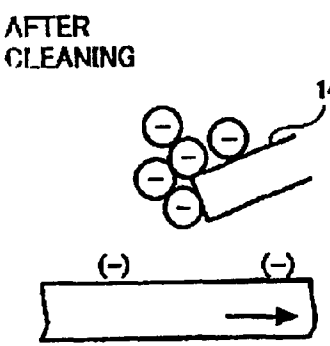

In a regular sheet conveying condition, a cleaning blade and a lubricant applying brush are not extremely stained with residual toner on an intermediate transfer belt. However, when a transfer sheet is jammed in a sheet conveying path and the operation of a machine is stopped, a relatively large amount of toner remains on the intermediate transfer belt as illustrated in FIGS. 3A and 3D. When the residual toner remaining on the intermediate transfer belt is scraped off by the cleaning blade, a relatively large amount of toner adheres to the cleaning blade, thereby staining the cleaning blade as illustrated in FIGS. 3B and 3E.

In another case, a relatively large amount of toner scrapped off by the cleaning blade may be carried to the lubricant applying brush by an air current caused by the rotation of the intermediate transfer belt, and may stain the lubricant applying brush.

In such an irregular sheet jam condition and an initial operation of the color copying machine after tuning on a power supply, a clearing sequence is executed so that toner held on the belt cleaning blade 14 and the lubricant applying brush 15 is controlled to be cleared therefrom.

According to the background art, after the cleaning process, a relatively large amount of toner adheres to a cleaning blade as illustrated in FIG. 3B. In a subsequent image forming process, the toner held on the cleaning blade is likely to move back to the intermediate transfer belt when the cleaning blade is brought into contact with the intermediate transfer belt as illustrated in FIG. 3C, staining a toner image carried on the intermediate transfer belt.

Figure 3F:
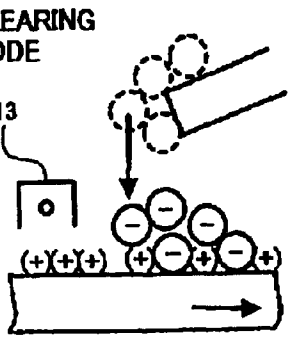
Figure 3G:
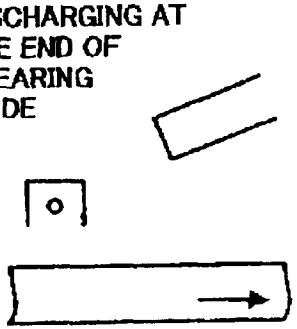

In a clearing sequence according to the embodiment of the present invention, after a relatively large amount of toner is scraped off by the belt cleaning blade 14 as illustrated in FIG. 3E, the discharger 13 charges the intermediate transfer belt 11 with a polarity opposite to that of the toner as illustrated in FIG. 3F while the intermediate transfer belt 11, the photosensitive drum 1, and the secondary transfer belt 31 are rotated. Thereby, the residual toner adhered onto the belt cleaning blade 14 and the lubricant applying brush 15 is electrostatically attracted to the intermediate transfer belt 11 and is cleared therefrom. Thereafter, the residual toner re-attached to the intermediate transfer belt 11 is transferred to the photosensitive drum 1 at the primary transfer region or to the secondary transfer belt 31 at the secondary transfer region, and is removed by the photosensitive drum cleaning unit 3 or the cleaning blade 39. By executing the above-described jobs, the residual toner adhered onto the belt cleaning blade 14 and the lubricant applying brush 15 is cleared therefrom, so that the clearing sequence is completed. Referring to FIG. 3G, just before the end of the clearing sequence, the discharging control in a regular image forming sequence is performed such that the charged potential of the intermediate transfer belt 11 equals nearly zero. The potential of the intermediate transfer belt 11 is adjusted for a subsequent image forming process.

Next, a construction of the respective devices in the color copying machine according to the present embodiment will be described.

An organic photoconductor (OPC) is used as the photosensitive drum 1. The photosensitive drum 1 is uniformly charged at from −200V to −2000V by the charger 2. The surface of the photosensitive drum 1 is irradiated with the laser light (L) corresponding to an image of an original document, thereby forming an electrostatic latent image on the surface of the photosensitive drum 1. In the color copying machine according to the present embodiment, toner used for developing the electrostatic latent image is negatively charged and a so-called negative-to-positive development is performed to form a toner image on the photosensitive drum 1. An intermediate transfer belt having a thickness of 0.15 mm, a width of 368 mm, and an inner peripheral length of 565.5 mm is employed as the intermediate transfer belt 11. Further, the moving speed of the intermediate transfer belt 11 is set to 245 mm/sec.

The intermediate transfer belt 11 includes a surface layer formed from an insulation layer of about 1 $\mu$m in thickness, an intermediate layer formed from an insulation layer made of polyvinylidene fluoride (PVDF) and having a thickness of about 75 $\mu$m and the volume resistivity of about $10^{13}$ ωcm, and a base layer formed from a middle resistance layer having the volume resistivity of from $10^{8}$ ωcm to $10^{11}$ ωcm and thickness of about 75 $\mu$m and made of PVDF and titanium oxide.

The measured volume resistivity of the entire intermediate transfer belt 11 is in a range of $10^{9}$ ωcm to $10^{14}$ ωcm. Specifically, the volume resistivity of the intermediate transfer belt 11 is measured in accordance with the volume resistivity measuring method described in JIS (Japanese Industrial Standards) K6911 while applying a voltage of 100V across the front and rear surfaces of the intermediate transfer belt 11 for ten seconds. The surface resistivity on the front surface of the intermediate transfer belt 11 is in a range of $10^{9}$ ωcm to $10^{14}$ ωcm when measured with a HIRESTA IP, a resistance meter available from Mitsubishi Chemical Corporation. Other than using this resistance meter, the surface resistivity may be measured in accordance with the surface resistance measuring method described in JIS K6911.

In the intermediate transfer unit 10, a metal roller plated with nickel is used as the primary transfer bias roller 17, and a metal roller is used as the ground roller 22. Other rollers are formed from a metal or a conductive resin. The primary transfer bias roller 17 is applied with an adequate value of electric field subjected to constant-current control, for example, 22 $\mu$A for the first color (Bk) toner image, 25 $\mu$A for the second color (C) toner image, 27 $\mu$A for the third color (M) toner image, and 29 $\mu$A for the fourth color (Y) toner image.

The intermediate transfer belt 11 is charged by applying a primary transfer bias to the primary transfer bias roller 17 from the primary transfer power supply 24. In this embodiment, the charging level of a non-image portion of the intermediate transfer belt 11 immediately before the secondary transfer is in a range of about −300V to −1500V. Further, the potential of the intermediate transfer belt 11 after the secondary transfer is in a range of about −100V to −300V.

In the secondary transfer unit 30, the secondary transfer bias roller 35 includes a surface layer formed from a conductive sponge or a conductive rubber and a core layer formed from a metal or a conductive resin. A transfer bias subjected to constant-current control in a range of 5 $\mu$A to 80 $\mu$A is applied to the secondary transfer bias roller 35. The secondary transfer belt 31 is formed from PVDF and has a thickness of 100 $\mu$m and a volume resistivity of $10^{13}$ ωcm.

A preferable result was obtained by performing an output control under the output conditions shown below in Table 1.

TABLE 1

| | Image forming sequence | Clearing sequence |
|---|---|---|
| Primary transfer output | 22 $\mu$A to 29 $\mu$A | 6 $\mu$A |
| Secondary transfer output | 50 $\mu$A | 14 $\mu$A |
| Discharging output | AC4.5 kV | AC4.5 kV + DC1kV |

Next, another embodiment of the present invention will be described. In the previous embodiment, the present invention is applied to the image forming apparatus including a single image carrier. Alternatively, the present invention may be applied to an image forming apparatus including a plurality of image carriers, for example, a tandem type image forming apparatus including four image carriers.

The basic construction and operation of a color copying machine in this embodiment are similar to those of the color copying machine in the above-described embodiment described referring to FIGS. 2A through 2J and FIGS. 3A through 3G, with exception that the color copying machine of this embodiment includes a plurality of photosensitive drums instead of a single photosensitive drum. Therefore, their descriptions are omitted here.

Figure 4:
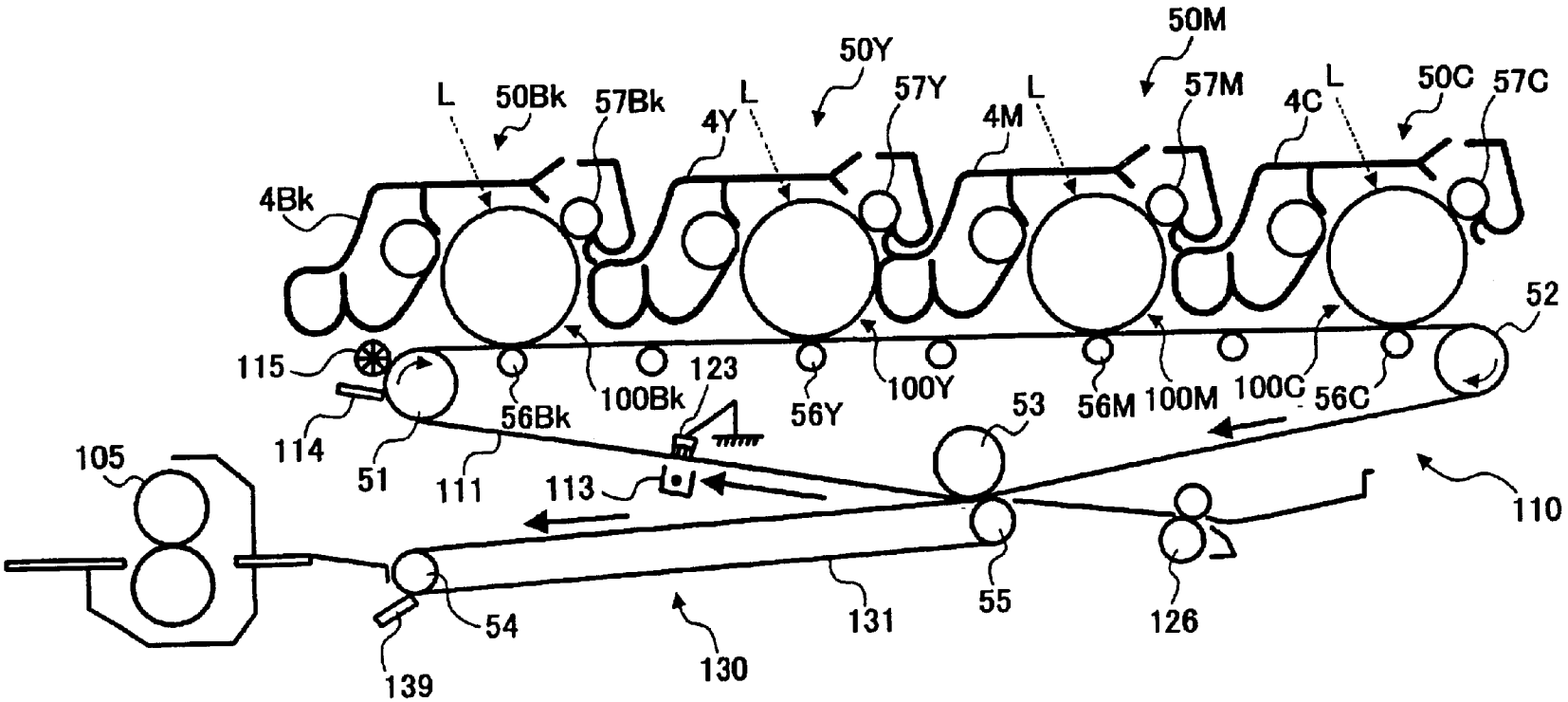
FIG. 4 is a schematic view illustrating a construction of an image forming section of a tandem type color copying machine according to another embodiment of the present invention.

FIG. 4 is a schematic view illustrating a construction of an image forming section of a tandem type color copying machine according to an embodiment of the present invention. Shown in the substantially central part of FIG. 4 is an intermediate transfer unit 110 including an endless-belt shaped intermediate transfer belt 111 as an intermediate transfer element. The intermediate transfer belt 111 is spanned around three support rollers 51, 52, 53 and is rotated in a clockwise direction indicated by the arrows on the support rollers 51, 52 in FIG. 4. One of the three support rollers 51, 52, 53 serves as a drive roller.

At the support roller 51 provided at the left side of the image forming section in FIG. 4, a belt cleaning blade 114 as an intermediate transfer element cleaning device and a lubricant applying brush 115 as a lubricant applying device are provided. The belt cleaning blade 114 removes residual toner remaining on the intermediate transfer belt 111 after a toner image is transferred to a transfer sheet from the intermediate transfer belt 111, i.e., the secondary transfer. The lubricant applying brush 115 applies a lubricant onto the intermediate transfer belt 111. Further, a discharger 113 is provided in downstream of the support roller 53 functioning as a secondary transfer bias roller and upstream of the belt cleaning blade 114 in the rotating direction of the intermediate transfer belt 111. The discharger 113 serves as a discharging/charging device that discharges and charges the intermediate transfer element, i.e., the intermediate transfer belt 111. A ground brush 123 is provided at a side opposite to the discharger 113 via the intermediate transfer belt 111. A discharging bias in which a direct current component is superimposed on an alternating current component is applied to the discharger 113 from a power supply (not shown).

An upper part of the intermediate transfer belt 111 stretched between the support rollers 51, 52, there is provided a tandem type image forming device in which four image units (50Bk, 50Y, 50M, 50C) are arranged along the moving direction of the intermediate transfer belt 111. In the image forming units (50Bk, 50Y, 50M, 50C), developing units (4Bk, 4Y, 4M, 4C), charging rollers (57Bk, 57Y, 57M, 57C), and other devices for an electrophotographic process (not shown) are arranged around photosensitive drums (100Bk, 100Y, 100M, 100C), respectively. A scanner unit (not shown) is arranged above the tandem type image forming device.

A secondary transfer unit 130 is provided below the intermediate transfer unit 110. In the secondary transfer unit 130, an endless-belt shaped secondary transfer belt 131 as a recording material carrier is spanned around two rollers 54, 55. A part of the secondary transfer belt 131 is pressed against the support roller 53 of the intermediate transfer unit 110, thereby forming a secondary transfer region where a toner image carried on the intermediate transfer belt 111 is transferred onto a recording material such as a transfer sheet. At the support roller 54, a cleaning blade 139 is arranged. The support roller 55 also serves as a secondary transfer bias roller, i.e., a secondary transfer device, to which a secondary transfer bias is applied from a power supply (not shown).

At the left side of the secondary transfer unit 130 in FIG. 4, a fixing device including a pair of fixing rollers 105 is provided. The fixing device fixes a toner image onto a recording material.

The secondary transfer unit 130 also has a function of conveying a recording material with a toner image transferred from the intermediate transfer belt 111 to the fixing device.

When copying in the color copying machine, an original document is set on a contact glass (not shown) in the scanner unit (not shown). When a copy start key on an operation panel (not shown) is pressed, the scanner unit is driven to read color image data on the original document. Further, when the copy start key on the operation panel is pressed, one of the support rollers 51, 52, 53 is driven to rotate by a drive motor (not shown), thereby rotating the intermediate transfer belt 111 while another two support rollers being driven to rotate. Substantially simultaneously, the photosensitive drums (100Bk, 100Y, 100M, 100C) are driven to rotate, and an optical writing unit (not shown) irradiates each surface of the photosensitive drums (100Bk, 100Y, 100M, 100C) with a laser light (L) based on the color image data on the original document read by the scanner unit, thereby forming an electrostatic latent image of each color. The electrostatic latent images on the photosensitive drums (100Bk, 100Y, 100M, 100C) are developed with color toner contained in the developing units (4Bk, 4Y, 4M, 4C), respectively, thereby forming single color images of black, yellow, magenta and cyan toners on the photosensitive drums (100Bk, 100Y, 100M, 100C), respectively. The single color images of black, yellow, magenta and cyan toners are sequentially transferred onto the intermediate transfer belt 111 by applying electric field to primary transfer bias rollers (56Bk, 56Y, 56M, 56C) as a primary transfer device, respectively, thereby forming a superimposed color toner image on the intermediate transfer belt 111.

In addition, when the copy start key is pressed, a recording material is fed from a sheet feeding section (not shown) and is in a standby condition at a nip part formed between a pair of registration rollers 126. Subsequently, the registration rollers 126 are rotated at the timing coincident with the formation of the superimposed color toner image on the intermediate transfer belt 111, and feed the recording material to the secondary transfer region between the intermediate transfer belt 111 and the secondary transfer belt 131. The superimposed color toner image is transferred onto the recording material from the intermediate transfer belt 111 at the secondary transfer region.

After the secondary transfer, the discharger 113 discharges the intermediate transfer belt 111 and residual toner remaining on the intermediate transfer belt 111. Subsequently, the residual toner remaining on the intermediate transfer belt 111 is removed by the belt cleaning blade 114 for the preparation of subsequent image formation by the tandem type image forming device.

In a clearing sequence according to this embodiment of the present invention, the discharger 113 charges the intermediate transfer belt 111 with a polarity opposite to that of the toner while the intermediate transfer belt 111, the photosensitive drums (100Bk, 100Y, 100M, 100C), and the secondary transfer belt 131 are rotated. Thereby, the residual toner adhered onto the belt cleaning blade 114 and the lubricant applying brush 115 is electrostatically attracted to the intermediate transfer belt 111 and is cleared therefrom. Thereafter, the residual toner re-attached to the intermediate transfer belt 111 is transferred to the photosensitive drums (100Bk, 100Y, 100M, 100C) at the primary transfer regions or to the secondary transfer belt 131 at the secondary transfer region, and is removed by each cleaning unit (not shown) provided for the photosensitive drums (100Bk, 100Y, 100M, 100C), or the cleaning blade 139. By executing the above-described jobs, the residual toner adhered onto the belt cleaning blade 114 and the lubricant applying brush 115 is cleared therefrom, so that the clearing sequence is completed. Just before the end of the clearing sequence, the discharging control in a regular image forming sequence is performed such that the charged potential of the intermediate transfer belt ill equals nearly zero. The potential of the intermediate transfer belt 111 is adjusted for a subsequent image forming process.

Next, a construction of the respective devices in the color copying machine according to the present embodiment will be described.

An organic photoconductor (OPC) is used as each of the photosensitive drums (100Bk, 100Y, 100M, 100C). Each of the photosensitive drums (100Bk, 100Y, 100M, 100C) is uniformly charged at from −200V to −2000V. Each surface of the photosensitive drums (100Bk, 100Y, 100M, 100C) is irradiated with the laser light (L) corresponding to color image data on an original document, thereby forming an electrostatic latent image on each surface of the photosensitive drums (100Bk, 100Y, 100M, 100C). In the color copying machine according to the present embodiment, toner used for developing the electrostatic latent image is negatively charged and a so-called negative-to-positive development is performed to form a toner image on each of the photosensitive drums (100Bk, 100Y, 100M, 100C). The intermediate transfer belt 111 is implemented by an elastic transfer belt having a three layer construction: a resin layer made of PVDF and having a thickness of 150 $\mu$m, an elastic layer made of a polyurethane polymer having a thickness of 150 $\mu$m, and a surface layer of 5 $\mu$m in thickness. Further, the moving speed of the intermediate transfer belt 111 is set to 200 mm/sec.

The measured volume resistivity of the entire intermediate transfer belt 111 is in a range of $10^9$ ωcm to $10^{14}$ ωcm. Specifically, the volume resistivity of the intermediate transfer belt 111 is measured in accordance with the volume resistivity measuring method described in JIS (Japanese Industrial Standards) K6911 while applying a voltage of 100V across the front and rear surfaces of the intermediate transfer belt 111 for ten seconds. The surface resistivity on the front surface of the intermediate transfer belt 111 is in a range of $10^9$ ωcm to $10^{14}$ ωcm when measured with a HIRESTA IP, a resistance meter available from Mitsubishi Chemical Corporation. Other than using this resistance meter, the surface resistivity may be measured in accordance with the surface resistance measuring method described in JIS K6911.

The support rollers 51, 52, 53 around which the intermediate transfer belt 111 is spanned are implemented by metal rollers or conductive resin rollers. Each of the primary transfer bias rollers (56Bk, 56Y, 56M, 56C) is applied with an adequate value of electric field subjected to constant-current control, for example, 30 $\mu$A for the first color (Bk) toner image, 32 $\mu$A for the second color (Y) toner image, 34 $\mu$A for the third color (M) toner image, and 36 $\mu$A for the fourth color (C) toner image.

The secondary transfer bias roller 55 includes a surface layer formed from a conductive rubber and a core layer formed from a metal or a conductive resin. A transfer bias subjected to constant-current control in a range of 5 $\mu$A to 80 $\mu$A is applied to the secondary transfer bias roller 55. The secondary transfer belt 131 is made of PVDF and has a thickness of 100 $\mu$m and a volume resistivity of $10^{13}$ ωcm.

A preferable result was obtained by performing an output control under the output conditions shown below in Table 2.

TABLE 2

| | Image forming sequence | Clearing sequence |
|---|---|---|
| Primary transfer output | 30 $\mu$A to 36 $\mu$A | 5 $\mu$A |
| Secondary transfer output | 50 $\mu$A | 10 $\mu$A |
| Discharging output | AC4.5 kV | AC4.5 kV + DC1kV |

As described above, according to the embodiments of the present invention, the dischargers 13, 113 are arranged in downstream of the secondary transfer bias rollers 35, 55 and upstream of the belt cleaning blades 14, 114 in a moving direction of the intermediate transfer belts 11, 111. Further, the ground brushes 23, 123 are provided on the rear sides of the intermediate transfer belts 11, 111. With these constructions, the charging condition of the residual toner and the intermediate transfer belts 11, 111 after the secondary transfer can be controlled before the residual toner remaining on the intermediate transfer belts 11, 111 is scraped off by the belt cleaning blades 14, 114. Therefore, the residual toner once scraped off by the belt cleaning blades 14, 114 is prevented from re-attaching to the intermediate transfer belts 11, 111 and thereby a high quality image can be obtained without deterioration of image due to the re-attachment of the residual toner to the intermediate transfer belts 11, 111.

In the above embodiments, a discharging bias, in which a direct current component and an alternating current component are superimposed, is applied to the dischargers 13, 113. Thereby, the residual toner and the intermediate transfer belts 11, 111 are effectively discharged, so that the residual toner is more effectively prevented from re-attaching to the intermediate transfer belts 11, 111.

Further, in the above embodiments, the dischargers 13, 113 charge the intermediate transfer belts 11, 111 with a polarity opposite to a polarity of toner so as to clear the toner adhered onto the belt cleaning blades 14, 114 while attracting the toner to the intermediate transfer belts 11, 111 from the belt cleaning blades 14, 114. Thereby, the toner adhered onto the belt cleaning blades 14, 114 is cleared, and the cleaning performance of the belt cleaning blades 14, 114 is increased. Further, the staining of a toner image carried on the intermediate transfer belts 11, 111 by the toner adhered onto the belt cleaning blades 14, 114 is prevented.

Moreover, in the above embodiments, the dischargers 13, 113 charge the intermediate transfer belts 11, 111 with a polarity opposite to a polarity of toner so as to clear the toner adhered onto the lubricant applying brushes 15, 115 while attracting the toner to the intermediate transfer belts 11, 111 from the lubricant applying brushes 15, 115. Thereby, the toner adhered onto the lubricant applying brushes 15, 115 is cleared, and the staining of a toner image carried on the intermediate transfer belts 11, 111 by the toner adhered onto the lubricant applying brushes 15, 115 is prevented.

The present invention has been described with respect to the embodiments as illustrated in the figures. However, the present invention is not limited to the embodiments and may be practiced otherwise.

For example, in the above-described two embodiments, a charger is used as an example of the dischargers 13, 113 for the intermediate transfer belts 11, 111, respectively. However, the present invention may be applied to another construction using a discharging/charging system. For example, the discharging/charging device for the intermediate transfer belts 11, 111 may be implemented by a contact type brush or roller.

Further, in the above embodiments, the image carrier is a photosensitive drum. However, the image carrier may be shaped in a form of an endless photosensitive belt.

In the above embodiments, the intermediate transfer element is an intermediate transfer belt. However, the intermediate transfer element may be shaped in a form of a drum.

In the above embodiments, the intermediate transfer belts 11, 111 may have any suitable electrical characteristics including a volume resistivity and a surface resistivity, thickness, structure, e.g., a single layer, two layers, etc., and material matching with image forming conditions.

Further, in the above embodiments, the contact type primary transfer bias rollers (17, 56Bk, 56Y, 56M, 56C) are employed as a primary transfer device. In place of the contact type transfer bias roller, a contact type transfer brush, a non-contact type transfer charger, etc. may be employed.

In the above embodiments, values of voltage and current applied to the primary transfer bias rollers (17, 56Bk, 56Y, 56M, 56C), the secondary transfer bias rollers 35, 55, the dischargers 13, 113 are examples and can be changed depending on various image forming conditions.

Moreover, in the above embodiments, the secondary transfer bias rollers 35, 55 are employed as a secondary transfer device. In place of a roller, a member such as a blade, a brush, etc. may be employed.

In the above embodiments, the secondary transfer belts 31, 131 are employed as a recording material carrier. In place of a belt, a member such as a drum may be employed.

Moreover, in the above embodiments, the image carrier is charged with a negative polarity, and a so-called negative-to-positive development is performed by using a two-component type developer, i.e., a toner and carrier mixture. Alternatively, the image carrier may be charged with a positive polarity, and a so-called positive-to-positive development may be performed by using a single component type developer, i.e., toner.

The present invention has been described with respect to a copying machine as an example of an image forming apparatus. However, the present invention may be applied to other image forming apparatuses such as a printer or a facsimile machine.

Further, in the above-described color copying machine, the order of forming images of respective colors and/or the arrangement of the developing units for respective colors are not limited to the ones described above and can be practiced otherwise.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

at least one image carrier configured to carry a visual image formed thereon;

an intermediate transfer element configured to carry the visual image from the at least one image carrier to a recording material;

a primary transfer device configured to transfer the visual image from the at least one image carrier onto the intermediate transfer element;

a secondary transfer device configured to transfer the visual image on the intermediate transfer element onto the recording material;

a cleaning device configured to make contact with the intermediate transfer element to remove developer remaining on the intermediate transfer element;

a discharging device configured to discharge the intermediate transfer element, the discharging device being positioned in downstream of the secondary transfer device and upstream of the cleaning device in a moving direction of the intermediate transfer element; and a grounding member configured to electrically around the intermediate transfer element at an opposite side of the discharging device with respect to the intermediate transfer element.

2. The image forming apparatus according to claim 1, wherein the discharging device is configured to discharge and charge the intermediate transfer element.

3. The image forming apparatus according to claim 2, wherein the discharging device charges the intermediate transfer element with a polarity opposite to a polarity of developer adhered onto the cleaning device so as to attract the developer to the intermediate transfer element and clear the developer from the cleaning device.

4. The image forming apparatus according to claim 2, further comprising a lubricant applying device configured to apply a lubricant onto the intermediate transfer element, wherein the discharging device charges the intermediate transfer element with a polarity opposite to a polarity of developer adhered onto the lubricant applying device so as to attract the developer to the intermediate transfer element and clear the developer from the lubricant applying device.

5. The image forming apparatus according to claim 1, further comprising a discharge power supply configured to apply a discharging bias, in which a direct current component and an alternating current component are superimposed, to the discharging device.

6. The image forming apparatus according to claim 1, wherein the at least one image carrier comprises a plurality of image carriers configured to carry visual images of different colors, respectively.

7. An image forming apparatus comprising:

carrying means for carrying a visual image formed thereon;

intermediate carrying means for carrying the visual image from the carrying means to a recording material;

primary transferring means for transferring the visual image from the carrying means onto the intermediate carrying means;

secondary transferring means for transferring the visual image on the intermediate carrying means onto the recording material;

removing means for removing developer remaining on the intermediate carrying means;

discharging means for discharging the intermediate carrying means, the discharging means being positioned in downstream of the secondary transferring means and upstream of the removing means in a moving direction of the intermediate carrying means; and grounding means for electrically grounding the intermediate carrying means at an opposite side of the discharging means with respect to the intermediate carrying means.

8. The image forming apparatus according to claim 7, wherein the discharging means is capable of discharging and charging the intermediate carrying means.

9. The image forming apparatus according to claim 8, wherein the discharging means charges the intermediate carrying means with a polarity opposite to a polarity of developer adhered onto the removing means so as to attract the developer to the intermediate carrying means and clear the developer from the removing means.

10. The image forming apparatus according to claim 8, further comprising lubricant applying means for applying a lubricant onto the intermediate carrying means, wherein the discharging means charges the intermediate carrying means with a polarity opposite to a polarity of developer adhered onto the lubricant applying means so as to attract the developer to the intermediate carrying means and clear the developer from the lubricant applying means.

11. The image forming apparatus according to claim 7, further comprising power supplying means for supplying a discharging bias, in which a direct current component and an alternating current component are superimposed, to the discharging means.

12. The image forming apparatus according to claim 7, wherein the carrying means is capable of carrying visual images of different colors.

13. A method of forming an image, comprising steps of:

forming a visual image on at least one image carrier;

transferring the visual image from the at least one image carrier onto an intermediate transfer element for carrying the visual image from the at least one image carrier to a recording material;

transferring the visual image from the intermediate transfer element onto the recording material;

discharging the intermediate transfer element;

electrically grounding the intermediate transfer element at an opposite side of a position of the intermediate transfer element being discharged; and mechanically removing developer remaining on the intermediate transfer element.

14. The method according to claim 13, further comprising charging the intermediate transfer element.

15. The method according to claim 14, wherein the charging step comprises charging the intermediate transfer element with a polarity opposite to a polarity of developer adhered onto a cleaning device for carrying out the removing step so as to attract the developer to the intermediate transfer element and clear the developer from the cleaning device.

16. The method according to claim 14, further comprising applying a lubricant onto the intermediate transfer element, wherein the charging step comprises charging the intermediate transfer element with a polarity opposite to a polarity of developer adhered onto a lubricant applying device for carrying out the applying step so as to attract the developer to the intermediate transfer element and clear the developer from the lubricant applying device.

17. The method according to claim 13, wherein the discharging step comprises applying a discharging bias, in which a direct current component and an alternating current component are superimposed, to the intermediate transfer element.

* * * * *